US012492619B2

(12) United States Patent
Brown

(10) Patent No.: US 12,492,619 B2
(45) Date of Patent: Dec. 9, 2025

(54) SIDE POCKET MANDREL WITH DIRECT CHECK VALVES

(71) Applicant: Baker Hughes Oilfield Operations LLC, Houston, TX (US)

(72) Inventor: Donavan Brown, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/389,566

(22) Filed: Nov. 14, 2023

(65) Prior Publication Data

US 2024/0159130 A1 May 16, 2024

Related U.S. Application Data

(60) Provisional application No. 63/425,279, filed on Nov. 14, 2022.

(51) Int. Cl.
*E21B 43/12* (2006.01)
*E21B 23/03* (2006.01)

(52) U.S. Cl.
CPC ..... *E21B 43/123* (2013.01); *E21B 23/03* (2013.01)

(58) Field of Classification Search
CPC ..... E21B 43/123; E21B 23/03
See application file for complete search history.

(56) References Cited

U.S. PATENT DOCUMENTS 2,649,272 A 8/1953 Barbato
2,845,940 A 8/1958 Garrett et al.
2,942,671 A 6/1960 Josephine
3,160,113 A 12/1964 Meyers
3,646,953 A 3/1972 Elliott et al.
3,654,949 A 4/1972 McMurry
(Continued)

FOREIGN PATENT DOCUMENTS

EP 2666957 A2 11/2013
WO 2004031529 A2 4/2004
(Continued)

OTHER PUBLICATIONS

Botil; Gas Lift Equipment Catalogue; www.botilindia.com; date unknown.

(Continued)

*Primary Examiner* — Dany E Akakpo
(74) *Attorney, Agent, or Firm* — Baker Hughes Patent Organization

(57) ABSTRACT

A side pocket mandrel for use in a gas lift system includes a primary flow bore that is linearly aligned with the primary longitudinal axis of the production tubing. The side pocket mandrel also includes valve pocket that is laterally offset from the primary flow bore, where the valve pocket includes a port that extends through the side pocket mandrel to the annular space (annulus) to place the interior of the valve pocket in fluid communication with the annulus. To prevent the unintended passage of fluids from the interior of the side pocket mandrel to the annulus through the valve pocket and port, the side pocket mandrel includes an integrated check valve within the port that permits the flow of fluids from the annuls into the side pocket mandrel, while preventing the passage of fluids from the side pocket mandrel to the annulus.

6 Claims, 5 Drawing Sheets

(56) References Cited

U.S. PATENT DOCUMENTS

| | | | | |
|---|---|---|---|---|
| 3,863,961 | A | 2/1975 | Dinning | |
| 3,874,445 | A | 4/1975 | Terral | |
| 3,888,273 | A | 6/1975 | Douglas | |
| 4,033,409 | A | 7/1977 | Hebert | |
| 4,035,103 | A | 7/1977 | McMurry et al. | |
| 4,066,128 | A * | 1/1978 | Davis | E21B 34/14 166/373 |
| 4,135,576 | A | 1/1979 | Tausch | |
| 4,146,091 | A | 3/1979 | Terral | |
| 4,265,306 | A | 5/1981 | Stout | |
| 4,295,795 | A | 10/1981 | Gass et al. | |
| 4,295,796 | A | 10/1981 | Moore | |
| 4,333,527 | A * | 6/1982 | Higgins | E21B 43/123 166/117.5 |
| 4,437,487 | A | 3/1984 | Marmon | |
| 4,505,331 | A | 3/1985 | Akkerman | |
| RE32,441 | E | 6/1987 | Higgins et al. | |
| 4,685,523 | A | 8/1987 | Paschal et al. | |
| 4,759,410 | A | 7/1988 | Benker et al. | |
| 5,176,164 | A | 1/1993 | Boyle | |
| 5,535,767 | A | 7/1996 | Schnatzmeyer et al. | |
| 5,971,004 | A | 10/1999 | Pringle | |
| 6,070,608 | A | 6/2000 | Pringle | |
| 6,148,843 | A | 11/2000 | Pringle | |
| 6,206,645 | B1 | 3/2001 | Pringle | |
| 6,375,155 | B1 | 4/2002 | Janssens | |
| 6,679,332 | B2 | 1/2004 | Vinegar et al. | |
| 6,715,550 | B2 | 4/2004 | Vinegar et al. | |
| 6,722,632 | B2 | 4/2004 | Kenny et al. | |
| 7,213,607 | B2 | 5/2007 | De | |
| 7,228,909 | B2 | 6/2007 | Schmidt et al. | |
| 7,658,229 | B2 | 2/2010 | Becker et al. | |
| 8,162,060 | B2 | 4/2012 | Randazzo | |
| 8,453,736 | B2 | 6/2013 | Constantine | |
| 8,714,264 | B2 | 5/2014 | Fay | |
| 8,881,825 | B2 | 11/2014 | White et al. | |
| 9,057,243 | B2 | 6/2015 | Hendel et al. | |
| 9,453,397 | B2 | 9/2016 | Dowling et al. | |
| 9,453,398 | B1 | 9/2016 | Zhang et al. | |
| 10,655,439 | B2 | 5/2020 | Murdoch et al. | |
| 10,677,028 | B2 | 6/2020 | Oliphant | |
| 10,787,889 | B2 | 9/2020 | Salihbegovic et al. | |
| 2001/0017157 | A1 | 8/2001 | Pringle | |
| 2002/0020533 | A1 | 2/2002 | Tubel | |
| 2007/0181312 | A1 | 8/2007 | Kritzler et al. | |
| 2007/0227739 | A1 | 10/2007 | Becker et al. | |
| 2013/0146155 | A1 | 6/2013 | Gilbertson et al. | |
| 2013/0220599 | A1 | 8/2013 | Rae | |
| 2014/0352982 | A1 | 12/2014 | White et al. | |
| 2020/0011155 | A1 | 1/2020 | Stamm et al. | |
| 2020/0032592 | A1 | 1/2020 | Romer et al. | |

FOREIGN PATENT DOCUMENTS

| | | | |
|---|---|---|---|
| WO | 2014022121 | A1 | 2/2014 |
| WO | 2016049726 | A1 | 4/2016 |
| WO | 2020212726 | A1 | 10/2020 |
| WO | 2022173815 | A1 | 8/2022 |

OTHER PUBLICATIONS

"MMRG Series Side Pocket Mandrels", Schlumberger, MMRG Series Side Pocket Mandrels, Sales Brochure, 2015.

"Side Pocket Mandrels", Parveen Industries Pvt. Ltd., Side Pocket Mandrels; www.parveen.in/products/side-pocket-mandrels; webpage captured Jul. 29, 2022.

Abdalsadig, Mohamed , et al., "Gas Lift Optimization Using Smart Gas Lift Valve", Abdalsadig et al., Gas Lift Optimization Using Smart Gas Lift Valve; World Academy of Science, Engineering and Technology International Journal of Mechanical and Mechatronics Engineering, vol. 10, No. 6, 2016.

Schlumberger , "Side Pocket Mandrels—Reliable Gas Lift with Flexibility for the Future; 17-AL-291763", Jan. 1, 2017.

Schlumberger , "SO2-30R-B Dual-Check Shear Orifice Gas Lift Valve", Schlumberger, SO2-30R-B Dual-Check Shear Orifice Gas Lift Valve; 2011, Jan. 1, 2011.

Schlumberger , "WRFC-H Wireline-retrievable flow control valve for gas lift applications", Schlumberger; WRFC-H Product Brochure; 09-CO-0263; 2010, Jan. 1, 2010.

Zhiyue, Xu , et al., "Smart Gas Lift Valves Eliminate Multiple Slickline Trips in Gas Lift Operations", Zhiyue, et al., Smart Gas Lift Valves Eliminate Multiple Slickline Trips in Gas Lift Operations, Offshore Technology Conference Asia, 2014.

"International Search Report and Written Opinion for PCT/US2023/037283 mailed Jan. 23, 2024".

* cited by examiner

SIDE POCKET MANDREL WITH DIRECT CHECK VALVES

RELATED APPLICATIONS

This application claims the benefit of U.S. Provisional Patent Application Ser. No. 63/425,279 filed Nov. 14, 2022 entitled, "Side Pocket Mandrel with Direct Check Valves," the disclosure of which is herein incorporated by reference.

FIELD OF THE INVENTION

This invention relates generally to the field of oil and gas production, and more particularly to a gas lift system that incorporates an improved side pocket mandrel with integrated check valves.

BACKGROUND

Gas lift is a technique in which gaseous fluids are injected into the tubing string to reduce the density of the produced fluids to allow the formation pressure to push the less dense fluid mixture to the surface. In annulus-to-tubing systems, pressurized gases are injected from the surface into the annulus, where the pressurized gases enter the tubing string through ports in the side pocket mandrel that communicate the injected gases through a gas lift valve inside the side pocket mandrel. Alternatively, in tubing-to-annulus systems, pressurized gases are injected into the tubing string and discharged into the annulus through the gas lift valve and ports, where the gases help to produce fluids out of the annulus. Thus, the gas lift valves allow access from the annulus into the production tubing or from the production tubing into the annulus. The gas lift valves can be configured to automatically open when the pressure gradient between the annulus and the production tubing exceeds the closing force holding each gas lift valve in a closed position.

To permit the unimpeded production of wellbore fluids through the production tubing, the gas lift valves are housed within "side pocket mandrels" that include a valve pocket (or side pocket tube) that is laterally offset from the primary longitudinal axis extending through the production tubing. Ports extend through the valve pocket and side pocket mandrel to provide a fluid path between the annulus and the interior of the valve pocket. Because the gas lift valves are contained in these laterally offset valve pockets, tools can be deployed and retrieved through the open primary passage (central bore) of the side pocket mandrel. The predetermined position of the gas lift valves within the production tubing string controls the entry points for gas into the production string. For illustration purposes, FIG. 1A depicts a PRIOR ART side pocket mandrel 200 in which gases injected into the annulus surrounding the side pocket mandrel 200 are admitted into the side pocket mandrel 200 through a gas lift valve 202 installed within the side pocket mandrel 200. The gas lift valve 202 is configured to open in response to a sufficient pressure gradient between the annulus and the interior of the side pocket mandrel 200.

When a well is first opened, the reservoir may have sufficient internal driving energy to produce a commercially adequate flow of the formation fluid to the surface. In time, however, that internal energy source may be dissipated long before the reservoir value is depleted. Production experience may anticipate such production developments by positioning side pocket mandrels in the production tube long before the actual need for gas lifted production. When the need for gas lifting arises, the only downhole operations required to begin gas lifting are the wireline placement of the gas lift valve elements in the respective side pockets. When compared to the enterprise of withdrawing and returning several miles of production tubing or coil tubing in a well, wireline procedures are minimal.

If the gas lift valve is not installed in the valve pocket or is removed for servicing or replacement, the ports in the side pocket mandrel allow the unregulated movement of fluids between the annulus and the interior of the side pocket mandrel. Without a gas lift valve in place to control the flow of fluids between the side pocket mandrel and the annulus, a portion of the produced fluids passing through the side pocket mandrel would tend to escape through the unregulated ports of the side pocket mandrel. FIG. 1B depicts the prior art side pocket mandrel 200 in which the gas lift valve 202 is not installed and fluids inside the side pocket mandrel 200 are permitted to escape into the annulus.

There is, therefore, a need for an improved side pocket mandrel that prevents the unintended discharge of produced fluids from the side pocket mandrel to the wellbore annulus. The present embodiments are directed to these and other deficiencies in the prior art.

SUMMARY OF THE INVENTION

In one aspect, embodiments of the present disclosure are directed to a side pocket mandrel for use in a gas lift system configured to improve the recovery of petroleum fluids from a well. The side pocket mandrel includes a primary flow bore that is linearly aligned with the primary longitudinal axis of the production tubing. The side pocket mandrel also includes valve pocket that is laterally offset from the primary flow bore, where the valve pocket includes a port that extends through the side pocket mandrel to the annular space surrounding the side pocket mandrel to place the interior of the valve pocket in fluid communication with the annular space. To prevent the unintended passage of fluids from the interior of the side pocket mandrel to the annulus through the valve pocket and port, the side pocket mandrel includes an integrated check valve within the port that permits the flow of fluids from the annulus into the side pocket mandrel, while preventing the passage of fluids from the side pocket mandrel to the annulus.

In another aspect, the present disclosure is directed to a side pocket mandrel for use in a gas lift system configured to improve the recovery of petroleum fluids from a well, where the gas lift system is surrounded by an annular space within the well. The side pocket mandrel has a central bore extending through the side pocket mandrel, a side pocket tube laterally offset from the central bore, a port that extends through the side pocket mandrel into the side pocket tube, and a check valve configured to control the movement of fluids through the port. The check valve includes a valve seat and a movable valve member that is configured to place the check valve in a closed state when the movable valve member is pressed against the valve seat.

WRITTEN DESCRIPTION

As used herein, the term "petroleum" refers broadly to all mineral hydrocarbons, such as crude oil, gas and combinations of oil and gas. The term "fluid" refers generally to both gases and liquids, and "two-phase" or "multiphase" refers to a fluid that includes a mixture of gases and liquids. "Upstream" and "downstream" can be used as positional references based on the movement of a stream of fluids from an upstream position in the wellbore to a downstream position on the surface. Although embodiments of the present invention may be disclosed in connection with a conventional well that is substantially vertically oriented, it will be appreciated that embodiments may also find utility in horizontal, deviated or unconventional wells. The term "fluids" refers to gases, liquids, and mixtures of gases and liquids.

Figure 1A:
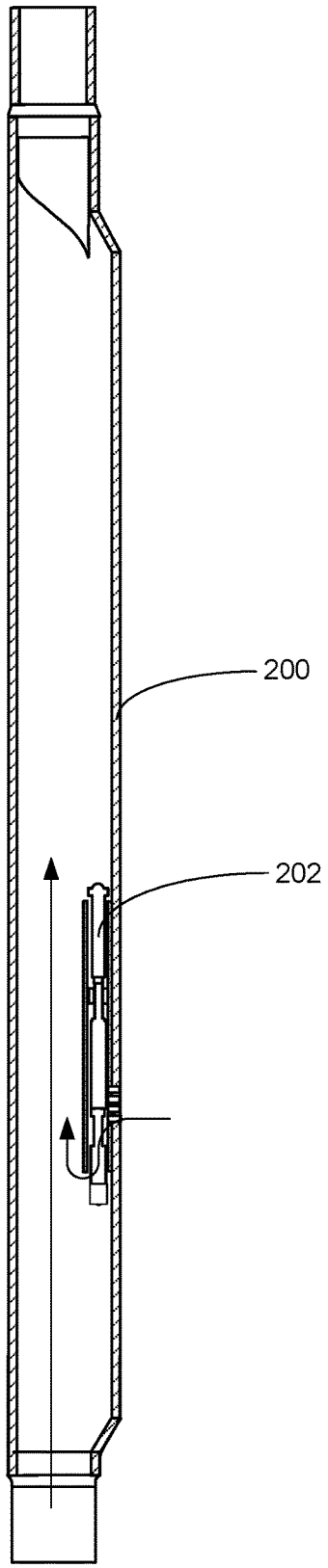
FIG. 1A PRIOR ART
FIG. 1A depicts a PRIOR ART side pocket mandrel in which a gas lift valve installed in the valve pocket is permitting the unidirectional flow of fluids from the annulus to the interior of the side pocket mandrel.
Figure 1B:
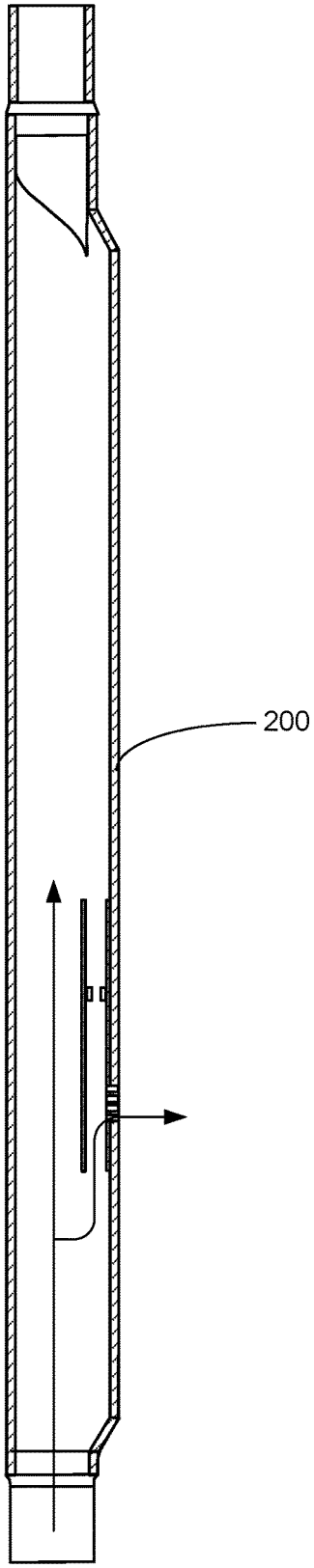
FIG. 1B PRIOR ART
FIG. 1B depicts a PRIOR ART side pocket mandrel in which fluids from the side pocket mandrel are escaping because a gas lift valve is not present to regulate the passage of fluids through an open port.
Figure 2:
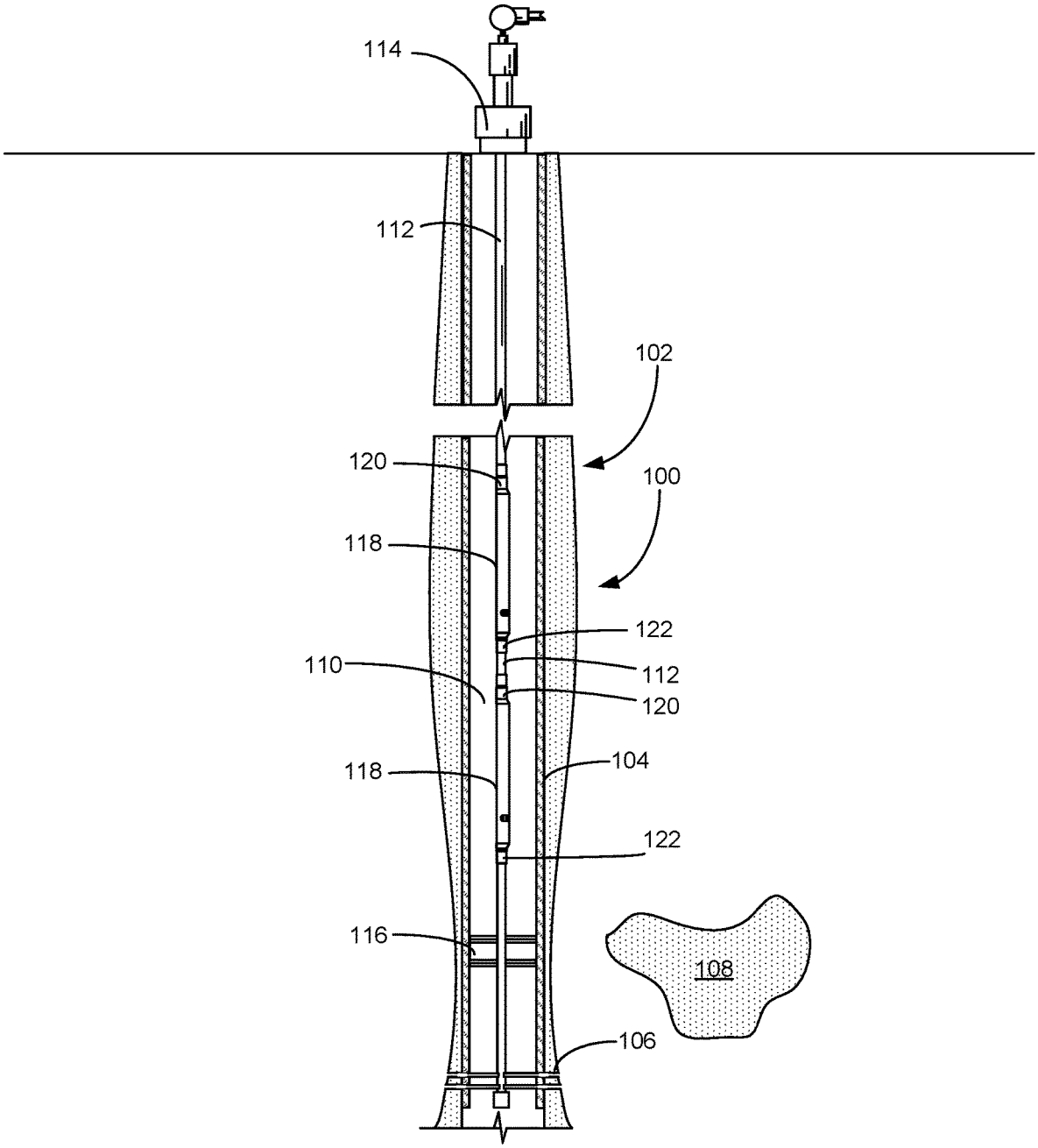
FIG. 2 is a schematic of a gas lift system constructed in accordance with an exemplary embodiment deployed in a wellbore.

Turning to FIG. 2, shown therein is a gas lift system 100 disposed in a well 102. The well 102 includes a casing 104 and a series of perforations 106 that admit wellbore fluids from a producing geologic formation 108 through the casing 104 into the well 102. An annulus or annular space 110 is formed between the gas lift system 100 and the casing 104. The gas lift system 100 is connected to production tubing 112 that conveys produced wellbore fluids from the formation 108, through the gas lift system 100, to a wellhead 114 on the surface. In the embodiment depicted in FIG. 1, the production tubing 112 extends through a packer 116 or other zone isolation device to an area of the well 102 near the perforations 106. In other embodiments, a cement completion is used to fill an uncased portion of the well 102 and the perforations 106 are formed through the cement completion. The gas lift system 100 also includes one or more side pocket mandrels 118 connected in line with the production tubing 112 above the packer 116.

Figure 3:
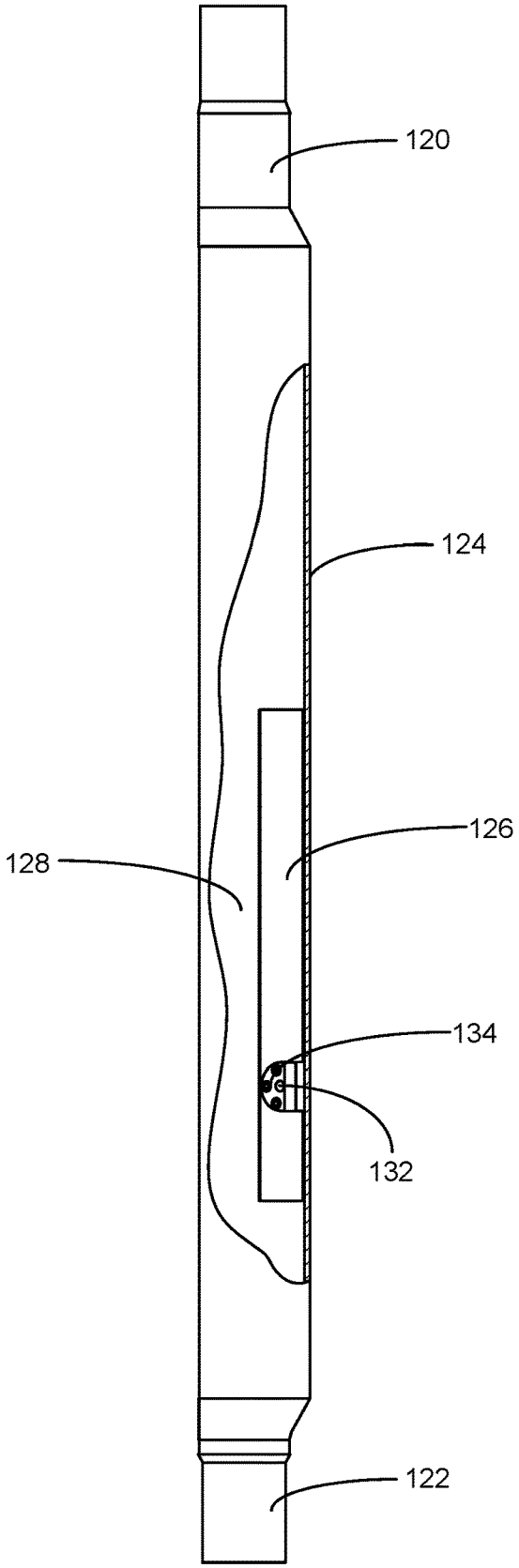
FIG. 3 is a side view of a side pocket mandrel of the gas lift system of FIG. 2 with an integrated check valve.
Figure 4:
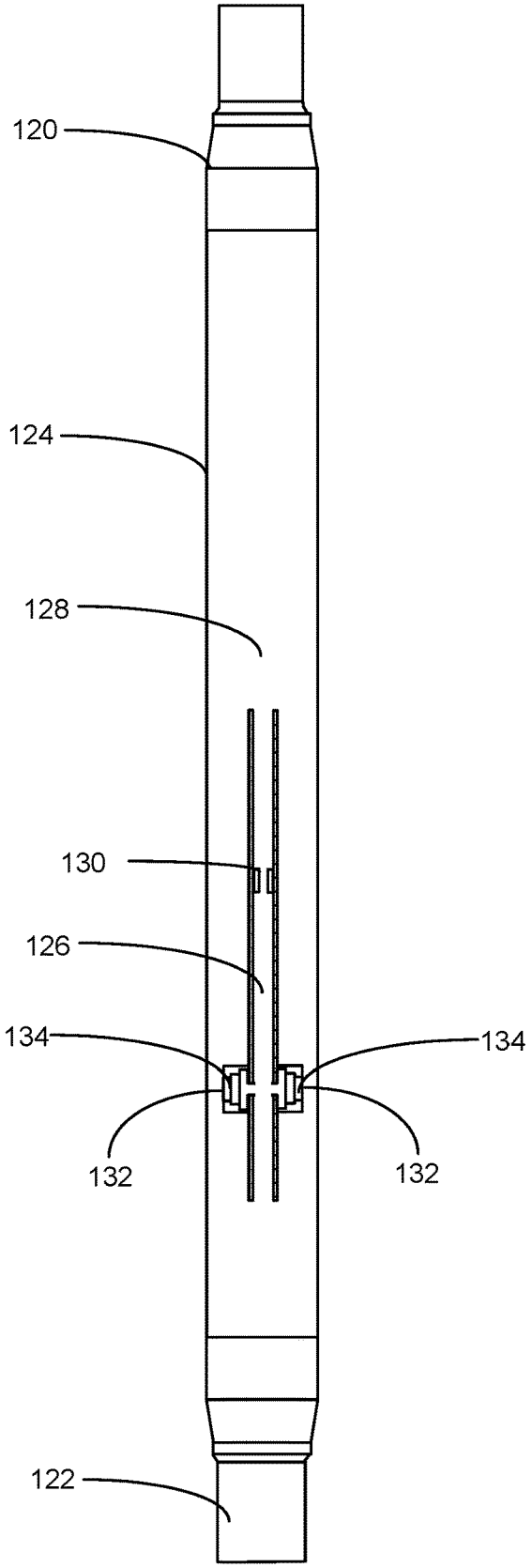
FIG. 4 is a top, partial cross-sectional view of the side pocket mandrel of FIG. 3 illustrating the use of two integrated check valves.

Turing to FIGS. 3 and 4, shown therein are front side (with partial cutaway) and right side cross-sectional views, respectively, of an exemplary embodiment of the side pocket mandrel 118. In FIG. 4, the side pocket mandrel 118 has been rotated such that the side pocket tube 126 is on top of the side pocket mandrel 118. The side pocket mandrel 118 generally includes an upper assembly joint 120 and a lower assembly joint 122 on opposite sides of the side pocket mandrel 118. The side pocket mandrel 118 includes an enlarged central portion 124 between the upper and lower assembly joints 120, 122. The central portion 124 has a larger diameter than the upper and lower assembly joints 120, 122 to accommodate the offset location of the gas lift valves.

The side pocket mandrel 118 includes a valve pocket or side pocket tube 126 within the central portion 124. The side pocket tube 126 is laterally offset from a central bore 128 that extends collinearly along the central longitudinal axis of the production tubing 112 and upper and lower assembly joints 120, 122. It will be appreciated that the side pocket tube 126 includes a latch mechanism 130 that is designed to releasably retain a gas lift valve or other downhole tool. A port 132 extends through the outer wall of the central portion 124 into the side pocket tube 126 to provide a path for fluids to move between the annular space 110 and the interior of the side pocket tube 126.

To prevent the unintended discharge of fluids from the interior of the side pocket mandrel 118 to the annular space 110, particularly when the gas lift valve is not installed in the side pocket tube 126, the side pocket mandrel 118 includes one or more integrated check valves 134. In the embodiment depicted in FIG. 4, the side pocket mandrel 118 includes two integrated check valves 134. Each of the check valves 134 is generally configured to automatically open to permit gases or other fluids to enter the side pocket tube 126 of the side pocket mandrel 118 through the corresponding port 132, while automatically closing to prevent the flow of fluids out of the side pocket mandrel 118 into the annular space 110.

Figure 5:
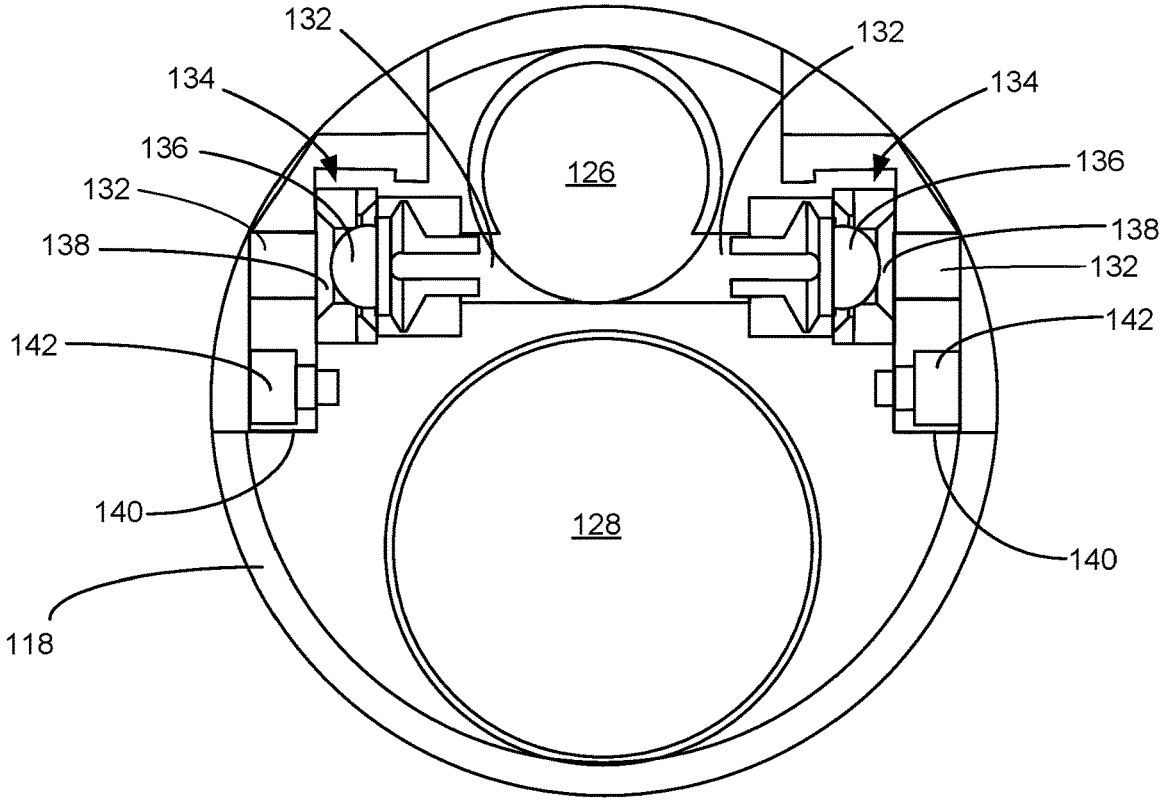
FIG. 5 is an end, cross-sectional view of the side pocket mandrel of FIG. 3 showing the integrated check valves in a first position that prevents the escape of fluids from the side pocket mandrel.
Figure 6:
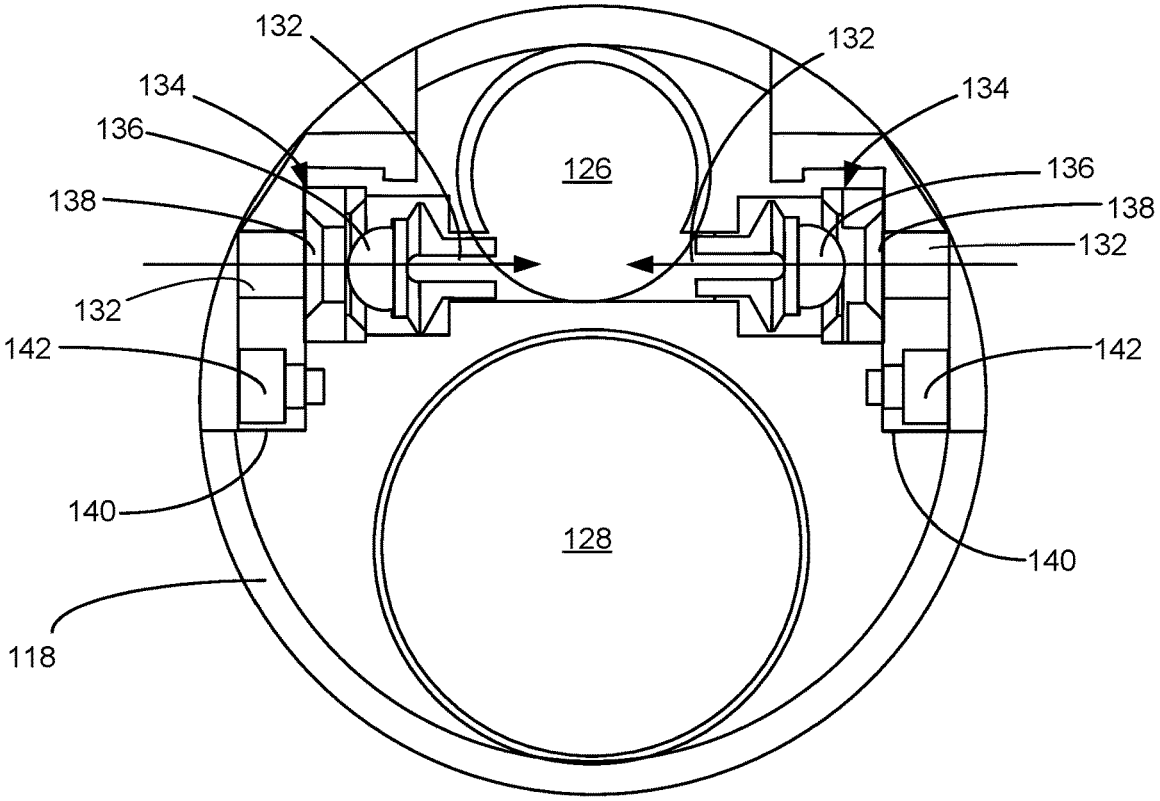
FIG. 6 is an end, cross-sectional view of the side pocket mandrel of FIG. 3 showing the integrated check valves in a second position that permits the introduction of gases from the annulus into the side pocket mandrel through the integrated check valves.
Figure 7:
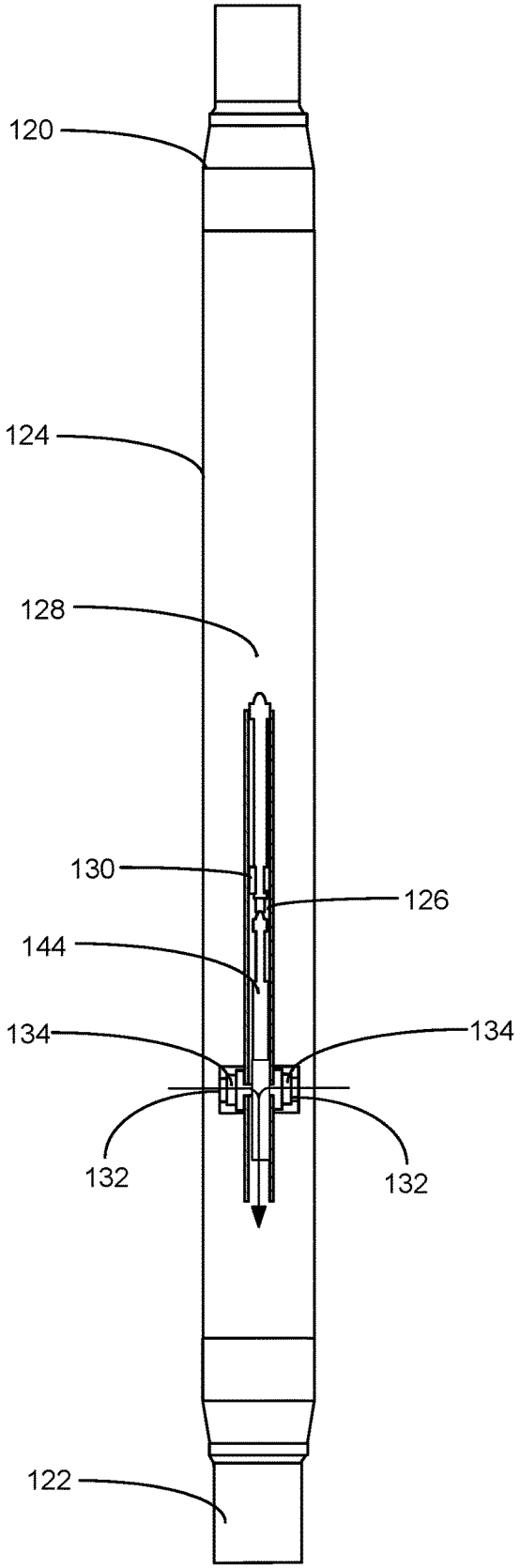
FIG. 7 is a top, partial cross-sectional view of the side pocket mandrel of FIG. 3 with a gas lift valve installed.

Turning to FIGS. 5 and 6, shown therein are cross-sectional depictions of the side pocket mandrel 118 showing the installation of the integrated check valves 134 on both sides of the side pocket tube 126. Each integrated check valve 134 includes a movable valve member 136 and a valve seat 138. The movable valve member 136 can be biased in a closed position against the valve seat 138 by a spring mechanism (not shown), or the movable valve member 136 can be allowed to move on and off the valve seat 138 in response to pressure gradients across the valve member 136. In FIG. 5, the valve member 136 is pressed into a "closed" position against the valve seat 138 by pressure inside the side pocket mandrel 118 overcoming the force exerted on the valve member by pressure in the annular space 110. In FIG. 6, the pressure in the annular space 110 exceeds the pressure inside the side pocket tube 126, which forces the valve member 136 into an "open" position off the valve seat 138. To permit the proper functioning of a gas lift valve 144 installed in the side pocket mandrel 118, as depicted in FIG. 7, the check valve 134 has an opening pressure that is less than the opening pressure of the gas lift valve 144. In this way, when the check valve 134 opens, gas flows from the annular space 110 through the check valve 134 and into the side pocket tube 126, where the passage of the pressurized gas is controlled by the installed gas lift valve 144. The gas lift valve 144, in turn, controls the passage of pressurized gas between the central bore 128 and the side pocket tube 126. Thus, in exemplary embodiments, the gas lift valve 144 and the check valve 134 are installed in a series configuration in which gases from the annular space 110 pass through both the check valve 134 and gas lift valve 144 before entering the central bore 128.

The integrated check valve 134 includes a low-profile design and can be installed in a shallow valve recess 140 that has been cut into the side pocket mandrel 118 adjacent to the side pocket tube 126. As best illustrated in FIGS. 5-6, the placement of the integrated check valves 134 in the valve recesses 140 conceals the integrated check valves 134 within the cross-sectional area of the side pocket mandrel 118 to reduce the risk of damaging the integrated check valves 134 during installation of the side pocket mandrel 118. The check valve 134 can be concealed within the valve recess 140 such that the check valve 134 does not extend beyond the outer diameter of the enlarged central portion 124 of the side pocket mandrel 118.

The integrated check valve 134 can be fastened within the valve recess 140 with fasteners 142 or by other attachment means, including welding. Although two check valves 134 are depicted in FIGS. 5 and 6, it will be appreciated that additional or fewer check valves 134 can be used in other embodiments. For example, it may be desirable to include four or more check valves 134 within each side pocket mandrel 118.

Importantly, the integrated check valve 134 is located on, or adjacent to, the port 132 rather than in a remote location within the side pocket mandrel 118. The placement of the integrated check valve 134 directly on the port 132 reduces restrictions and pressure losses that would otherwise be created by the placement of the check valve 134 in a position from that is spaced apart from the port 132.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A side pocket mandrel for use in a gas lift system configured to improve the recovery of petroleum fluids from a well, where the gas lift system is surrounded by an annular space within the well, the side pocket mandrel comprising:

a central bore extending through the side pocket mandrel;

a side pocket tube laterally offset from the central bore;

a gas lift valve installed in the side pocket tube that controls the passage of gases between the side pocket tube and the central bore, wherein the gas lift valve automatically opens when the pressure in the annular space exceeds an opening pressure of the gas lift valve;

a port that extends through the side pocket mandrel into the side pocket tube, wherein the port and side pocket tube are substantially orthogonal to one another; and a check valve concealed within the port and configured to control the movement of fluids from the annular space through the port, wherein the check valve comprises:

a valve seat; and a movable valve member that is configured to open when the pressure in the annular space is greater than the pressure in the side pocket tube and wherein the opening pressure of the gas lift valve is greater than the pressure required to open the check valve.

2. The side pocket mandrel of claim 1, further comprising a valve recess adjacent to the side pocket tube.

3. The side pocket mandrel of claim 2, wherein the check valve is a low-profile check valve that is concealed within the valve recess such that the low-profile check valve does not extend beyond an outer diameter of the side pocket mandrel.

4. The side pocket mandrel of claim 1, wherein the side pocket mandrel comprises a plurality of check valves.

5. The side pocket mandrel of claim 1, wherein the movable valve member is configured to move into an open position off the valve seat when the pressure in the annular space is greater than the pressure inside the side pocket tube.

6. The side pocket mandrel of claim 1, wherein the gas lift valve and the check valve are arranged in a series configuration such that gases from the annular space must pass through the check valve before reaching the gas lift valve.

* * * * *